US010090649B2

(12) United States Patent
Berkemeier et al.

(10) Patent No.: US 10,090,649 B2
(45) Date of Patent: Oct. 2, 2018

(54) SPARK PLUG HAVING A POWDER CAPSULE

(71) Applicant: Ford Global Technologies, LLC, Dearborn, MI (US)

(72) Inventors: Oliver Berkemeier, Bergisch Gladbach (DE); Helmut Hans Ruhland, Eschweiler (DE); Bernd Steiner, Bergisch Gladbach (DE); Krystian Dylong, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 113 days.

(21) Appl. No.: 15/213,036

(22) Filed: Jul. 18, 2016

(65) Prior Publication Data

US 2017/0025827 A1 Jan. 26, 2017

(30) Foreign Application Priority Data

Jul. 24, 2015 (DE) ..... 10 2015 214 057

(51) Int. Cl.
*H01T 21/02* (2006.01)
*H01T 13/34* (2006.01)
*H01T 13/41* (2006.01)

(52) U.S. Cl.
CPC ..... *H01T 21/02* (2013.01); *H01T 13/34* (2013.01); *H01T 13/41* (2013.01)

(58) Field of Classification Search
CPC ..... H01T 21/02; H01T 13/34
See application file for complete search history.

(56) References Cited

U.S. PATENT DOCUMENTS

| | | | |
|---|---|---|---|
| 3,931,055 | A | 1/1976 | Friese |
| 4,004,183 | A | 1/1977 | Oki et al. |
| 5,463,267 | A | 10/1995 | Conway |
| 6,464,906 | B1 | 10/2002 | Niwa et al. |
| 7,223,144 | B2 | 5/2007 | Aisenbrey |
| 8,431,317 | B2 | 4/2013 | Tsubaki et al. |
| 2010/0044929 | A1 | 2/2010 | Boehler |

FOREIGN PATENT DOCUMENTS

| | | | |
|---|---|---|---|
| DE | 4142982 | A1 | 7/1993 |
| EP | 1706924 | B1 | 11/2008 |

*Primary Examiner* — Joseph L Williams
(74) *Attorney, Agent, or Firm* — Julia Voutyras; McCoy Russell LLP

(57) ABSTRACT

The present disclosure relates to methods for producing spark plugs and/or spark plug components, and a capsule which may be used to produce a spark plug or spark plug component. The capsule may include a housing of a material which is unstable when heated a threshold temperature, and the capsule may further be filled with one or more powders, whereupon heating of the capsule of the housing may break down and the powders may be sintered or fused into a resistive body. The presently disclosed method may simplify and/or reduce the cost of producing spark plugs using known methods of inserting powdered precursor materials.

20 Claims, 7 Drawing Sheets

SPARK PLUG HAVING A POWDER CAPSULE

CROSS REFERENCE TO RELATED APPLICATION

This application claims priority to German Patent Application No. 102015214057.1, filed Jul. 24, 2015, the entire contents of which are hereby incorporated by reference for all purposes.

FIELD

The present disclosure relates to a method for producing spark plugs, a capsule for use in the production method in accordance with the disclosure, and a method for producing a spark plug component.

BACKGROUND/SUMMARY

Spark plugs are used in gasoline engines, gas turbines and some furnaces in order to ignite an air-gas mixture located in a combustion chamber by generating an ignition spark. Typically, a high voltage is generated by an ignition coil and said high voltage prevails on a central electrode of the spark plug and generates the ignition spark by jumping between the central electrode and a ground electrode that is arranged near to the central electrode.

The ignition voltage reaches the central electrode by way of an electrical resistance. This electrical resistance is typically generated in the interior of a ceramic insulator of the spark plug in that a powder is introduced into the insulator and is fused or sintered to become a resistor at that location by heating the powder. A sequence of different powders may also be used; for instance, a layer of powder having a comparatively low resistance may be followed by a layer with a higher resistance, whereupon finally a layer of powder having the low resistance is applied again. The layers of the powder having the low resistance improve the contact of the electrical resistor that is to be generated with the central electrode on one side and the connecting electrode on the other side of the resistor. The high expense of the procedure of introducing the powder into the insulator of the spark plug is disadvantageous in current production methods. In addition, current methods may not produce a reliable rate of product meeting quality specification tolerances.

The inventors herein have recognized the above challenges of producing a spark plug reliably and with minimal expense. The present disclosure therefore provides methods of producing a spark plug and/or a component of a spark plug, and provides a powder capsule which may enable a simplified, more reliable, and/or less expensive production method. In some examples, the powder capsule may ease materials handling during manufacturing and/or reduce a process cycle time.

A first aspect of the disclosure relates to a method for producing spark plugs, comprising providing a spark plug blank having an insulator that may comprise a hollow chamber that extends along a longitudinal axis of the insulator, arranging a central electrode in the hollow chamber of the insulator so that an end of the central electrode which may protrude beyond an end of the central electrode over a combustion chamber end of the insulator, providing a capsule filled with at least one powder, inserting the capsule into the hollow chamber of the insulator, arranging a connecting electrode in the hollow chamber of the insulator so that an end of the connecting electrode protrudes beyond a connecting end of the insulator, and heating the capsule.

Another aspect of the present disclosure relates to a capsule for use in producing a spark plug or spark plug component, such as a spark plug resistor or resistor assembly, wherein the capsule may be filled with at least one powder.

Another aspect of the present disclosure relates to a method for producing a spark plug resistor, wherein the method may comprise providing an insulator comprising a central cavity passing through the insulator. The method may further comprise providing a capsule, comprising a housing which becomes unstable when heated to a first threshold temperature, and further comprising one or more powders, which may fuse or sinter into an electrically resistive mass when heated to a second threshold temperature. The method may further comprise arranging the capsule in the central cavity of the insulator, compressing the capsule, and heating the capsule to heating the capsule to a threshold temperature exceeding each of the first and second threshold temperatures, such that the capsule is fused or sintered into an electrically resistive mass.

A production method in accordance with the present disclosure comprises the advantage that it is rendered possible to rapidly and reliably fill the hollow chamber of the insulator of the spark plug with the at least one powder. The amount of powder, and where required a desired layer sequence of powders, may be implemented in a simpler and more precise manner outside the insulator than within the insulator. It may be possible to inexpensively produce a spark plug by inserting a powder capsule into the insulator, and in the case of using multiple different powders, it may be possible by using a powder capsule to maintain a layer sequence of one or more powders or powder zones in a reliable manner.

The procedure may further comprise compressing the capsule arranged in the hollow chamber between the central electrode and the connecting electrode. The compressing procedure may increase the tensile strength of the powder that may be fused or sintered when heating the capsule and may lead to a more robust spark plug. In one embodiment, compressing and heating may be performed simultaneously. However, the compressing procedure may commence prior to the heating procedure and/or may be continued for some time after the end of the heating procedure, for example until the temperature falls below a predetermined threshold temperature.

A method in accordance with the present disclosure may further comprise producing or providing a capsule that may be filled with at least one powder. In one embodiment, producing the capsule may further comprise producing a capsule housing and/or filling the capsule with the at least one powder. The capsule may be manufactured in a two-part manner so that a capsule body may be filled with the at least one powder and may further be subsequently closed by a capsule cap. In one embodiment, the capsule may be a cassette, for example a wax cassette.

In one embodiment, a first region of a capsule may be filled with a first powder having a first electrical resistance and a second region of the capsule may be filled with a second powder having an electrical resistance that may be different from the first electrical resistance. In particular, the second region may be divided into a first part and a second part that may be arranged and spatially separated from one another on opposite-lying sides of the first region. In a further embodiment, the first electrical resistance may be greater than the second electrical resistance. The regions having the second powder may ensure a good contact between one or more of the electrodes and the first region having the first powder that has the greater resistance. The use of a capsule may offer particular advantages with regard to the expense of the method, especially in the case where different powders are layered and the layers may possibly be of different thicknesses.

The capsule housing may be manufactured at least in part from a material that may be unstable when subjected to heat above a threshold temperature. By way of example, the end faces and/or the peripheral surfaces of the capsule may be manufactured from the material that may be unstable when subjected to heat. Suitable materials may by way of example be a wax or a polymer. During heating of the capsule, the capsule may be heated to above this threshold temperature so that the material that may be unstable when subjected to heat becomes volatile, by way of example as a result of burning or evaporating.

The capsule housing may also be manufactured entirely or in part from a material that may be stable when subjected to heat at the temperature that prevails during heating of the capsule. For example, it may be feasible to manufacture the peripheral surface of the capsule from an electrically insulating material and to manufacture the end faces from an electrically conductive material. Where appropriate, it may be possible to select the material of the end faces or the temperature during heating of the capsule so that the material of the end faces melts and thus may contribute to providing a good contact with the resistive powder.

In one embodiment, the temperature during heating of the capsule may be selected so that the at least one powder may be sintered or melted during heating of the capsule.

Further aspects of the disclosure relate to a capsule that may be filled with at least one powder for use in the methods in accordance with the disclosure for producing a spark plug and a spark plug that may be produced according to the methods.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for producing a spark plug in accordance with the present disclosure. The exemplary embodiments are explained in detail hereinunder with reference to illustrations of the exemplary embodiments.

The description herein relates to methods for producing at least one of spark plugs, spark plug components, or spark plug subassemblies. Specifically, methods disclosed herein relate to the formation of an electrical resistor component of a spark plug. Further described is a powder capsule which may be used in conjunction with one or more methods for producing said spark plugs, components, or subassemblies. The methods disclosed herein detail a process or subprocess by which filling of a spark plug subassembly, such as a spark plug blank, with a powdered precursor for the formation of a resistor within the spark plug blank, may be simplified and/or improved in a quality tolerance yield. A powder capsule may be produced in a process or subprocess of manufacturing a spark plug, or in a process of manufacturing a spark plug component, precursor component, or subassembly. The powder capsule may contain the powdered precursor for formation of the resistor enclosed or encapsulated therein, such that the capsule itself may be more easily, and/or with less waste, inserted into a spark plug subassembly in a production process. A housing and/or binder of the capsule may be transformed by heat such that the housing and/or binder becomes unstable and is removed or rendered inert in the assembly, and the powdered precursors may be further formed by heat into an electrically resistive mass for use as a resistor in a spark plug. The following figures and description disclose exemplary embodiments of methods and components in accordance with the present disclosure.

Figure 1:
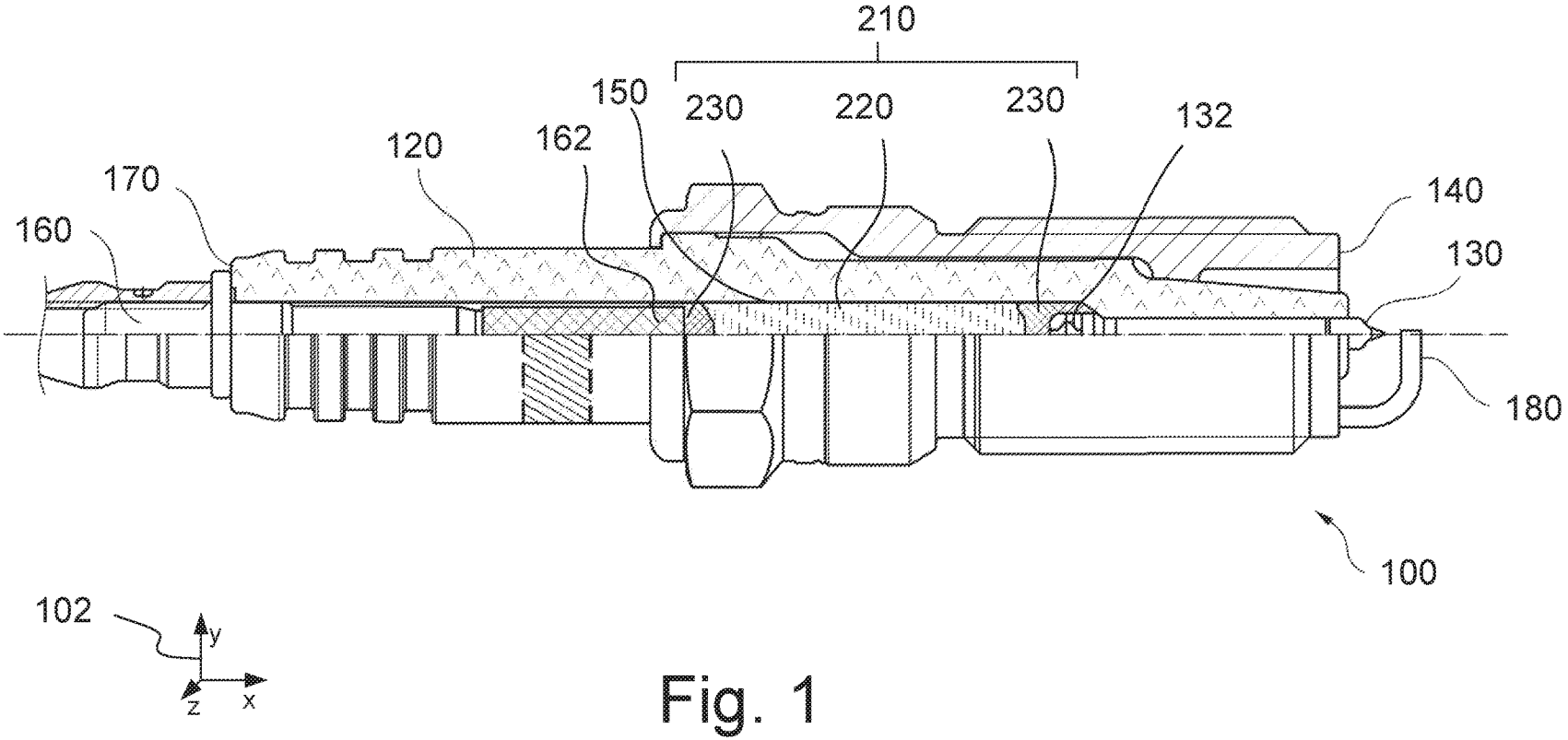
FIG. 1 illustrates a sectional view of a spark plug as may be produced in accordance with a method of the present disclosure.

FIG. 1 illustrates a sectional view of a spark plug 100 as may be produced with a method in accordance with the present disclosure. Axes 102 show a relative viewing angle of the components illustrated in FIGS. 1-6. A method for producing the spark plug 100 may be based on a spark plug blank that in particular may comprise an insulator 120 but may also comprise other components such as a ground electrode 180, connectors and/or threading, exterior grooves and/or gripping hardware, and more of the like. The insulator 120 may be manufactured from a material that may be stable when subjected to heat and may be also electrically insulating, such as ceramic. The insulator 120 may further comprise a combustion chamber end 140 and a connecting end 170. The combustion chamber end 140 may be an end of insulator 120 which is inserted into a combustion chamber, such as a cylinder of an engine, and connecting end 170 may be an opposite end to combustion chamber end 140 and may be an end which connects to a conducting voltage source, such as a spark plug cable (not shown). Spark plug 100 may also have a corresponding combustion chamber end 140 and connecting end 170. Insulator 120 may in one embodiment be generally cylindrical in shape, which in some examples may comprise a complex external profile featuring grooves, ridges, and/or zones of differing radial thickness. For example, insulator 120 may have a wider radius at combustion chamber end 140 than at connecting end 170. In one embodiment, insulator 120 may have a cavity spanning its longitudinal axis, which cavity may take the shape of a cylindrical cavity, or may have a complex radial profile such that the radius of the cavity may be nonuniform at various axial positions. For example, a central cavity may comprise a ridge which may provide a supporting structure for the placement of an electrode, such as central electrode 130. One or more ends of the central cavity may be open.

Central electrode 130 may be provided on one combustion chamber end 140 of the insulator 120, and may extend into the central cavity of the insulator 120. Said combustion chamber end 140 may face a combustion chamber of an internal combustion engine or the like, and a high electrical voltage that generated for the ignition procedure may jump from said central electrode 130 to a ground electrode 180, and in so doing may generate an ignition spark. A connecting electrode 160 may be arranged on a connecting end 170 of the insulator 120, said connecting end being opposite the combustion chamber end 140, and said connecting electrode may be used for providing electrical contact between the spark plug 100 and an arrangement for generating the required ignition voltage such as an ignition coil. Connecting electrode 160 may be a conductive plug or member which may comprise one or more of a threaded or a pressure-fitted connector, which may protrude from connecting end 170 of insulator 120 and may be joined with a voltage source such as a spark plug cable (not shown). Connecting electrode 160 may be inserted into a central cavity of insulator 120 such that at least a portion of the electrode extends into the interior of the central cavity. The insulator 120 in one embodiment comprises a central cavity such as hollow chamber 150 along its longitudinal axis, and the connecting electrode 160 and the central electrode 130 may be arranged in said hollow chamber. In the illustrated embodiment, components including connecting electrode 160, central electrode 130, and resistor 210 may largely fill hollow chamber 150.

In one embodiment, a gap, which may be a zone of hollow chamber 150, may be embodied between the connecting electrode interior end 162 and the central electrode interior end 132, wherein said ends do not touch. Said gap may be filled with an electrical resistor 210 in the completed state of the spark plug 100, said electrical resistor 210 being contacted on its opposite ends by the connecting electrode 160 and the central electrode 130. In one embodiment, electrical resistor 210 may be a mass of an electrically resistive material. In a further embodiment, electrical resistor 210 may be a fused or sintered powder, or resistive mass created from a fused or sintered precursor powder. In a further embodiment, electrical resistor 210 may comprise a plurality of zones of different electrical and/or material properties. In one example, electrical resistor 210 may comprise a first zone 220 and a second zone 230. Second zone 230 may be split into two separated parts, which may further be at opposite ends of electrical resistor 210. In a further example, the electrical resistance of first zone 220 may be higher than the electrical resistance of the second zone 230. Second zone 230 may make electrical contact with central electrode 130 and/or connecting electrode 160, and may also make electrical contact with first zone 220. The resistance of second zone 230 may be selected such that good electrical contact is made between an electrode such as central electrode 130, or connecting electrode 160, and first zone 220, said contact being made across second zone 230.

In a further embodiment, said electrically resistive mass may be compressed, and may further be fused and/or sintered from a precursor material. In one example, said precursor material may be one or more powders. The electrical resistor 210 may be pressed against the central electrode interior end 132 and/or connecting electrode interior end 162, such that electrical contact is made between the electrical resistor 210 and one or more of said electrodes. The electrical resistor 210 may electrically join connecting electrode 160 and central electrode 130, such that a voltage may be transmitted between said electrodes. In one embodiment, a voltage supplied to connecting electrode 160 from a voltage source, such as an ignition coil (not shown), may be transmitted via the electrical resistor 210 to central electrode 130 such that said voltage may jump from central electrode 130 to ground electrode 180, wherein a spark may be generated at the location of said jump.

Figure 2:
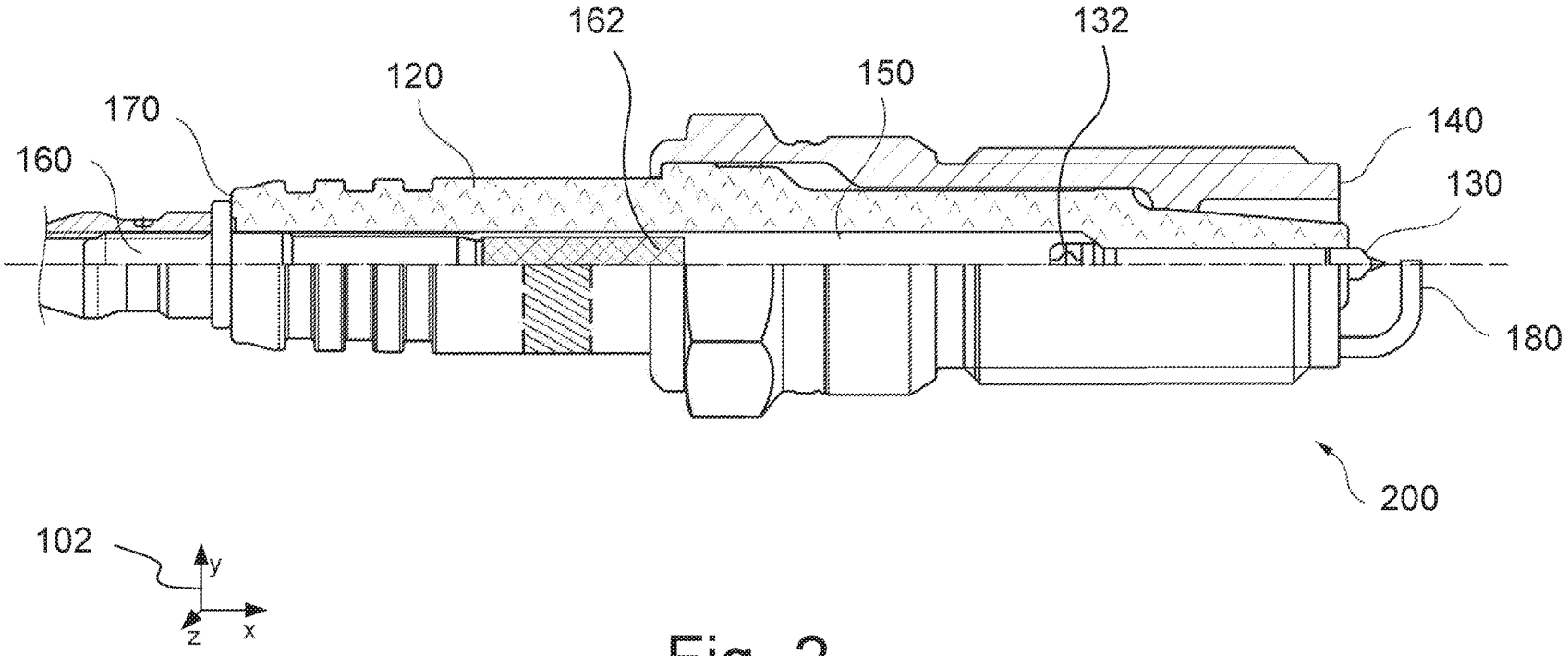
FIG. 2 illustrates a sectional view of a spark plug blank as may be used in accordance with a method of the present disclosure.

FIG. 2 illustrates a sectional view of a spark plug blank 200 which may be used to produce spark plug 100. Spark plug blank 200 comprises insulator 120 as well as hollow chamber 150, which in the illustrated embodiment is a central cavity passing through the longitudinal center of insulator 120. Spark plug blank may further comprise central electrode 130 and connecting electrode 160, which are illustrated as fully inserted into hollow chamber 150. In one embodiment, one or more of central electrode 130 and connecting electrode 160 may be removed from hollow chamber 150. In a further embodiment, central electrode 130 and connecting electrode 160 may be disassociated from insulator 120 prior to assembly of spark plug 100, and may be inserted individually into hollow chamber 150 at appropriate points in an assembly process. For example, an assembly process may comprise providing spark plug blank 200 with central electrode 130 and connecting electrode 160 initially removed from hollow chamber 150. Central electrode 130 may be inserted into hollow chamber 150 from connecting end 170, followed by the insertion of a powder capsule, followed by insertion of connecting electrode 160. In a further example, a powder capsule may be compressed between central electrode interior end 132 and connecting electrode interior end 162 upon insertion of connecting electrode 160.

In accordance with a method of the present disclosure for producing a spark plug 100, a capsule filled with at least one powder may be arranged in the hollow chamber 150 between the connecting electrode 160 and the central electrode 130. In one embodiment, hollow chamber 150 and insulator 120 may be components of spark plug blank 200. The spark plug blank 200 may comprise insulator 120, inside a central cavity of which one or more of central electrode 130, a capsule filled with at least one powder, and connecting electrode 160 may be arranged for producing spark plug 100. In one embodiment, the central cavity may be hollow chamber 150. The capsule may further be heated, whereby in one embodiment of the present disclosure a housing of the capsule may be broken down. In addition, the heating procedure causes the powder that may be contained in the capsule to fuse or sinter into a solid body. In one embodiment, the capsule may be arranged in a central cavity of insulator 120 and heated in place to a threshold temperature, whereby the desired electrical resistor 210 may then be formed as a component of spark plug 100. In a further embodiment, the central electrode 130 may be initially inserted into the insulator 120 before the capsule, and heated in place for the formation of an electrical resistor 210. The capsule may also be arranged inside insulator 120 and compressed from one or more ends by one or more of central electrode 130, connecting electrode 160, and a compressing tool or tools which may be inserted into insulator 120 for at least the purpose of compressing the capsule. In yet another embodiment, central electrode 130 and the capsule may be inserted into insulator 120 followed by connecting electrode 160, whereby the capsule may be heated and an electrical resistor 210 may be formed in place.

It is possible for the sequence to further deviate from the examples described. For instance, the electrode that is inserted last, for instance the connecting electrode 160, may be used in order to compress the capsule having the at least one powder during heating of the capsule, which may support the process of fusing or sintering. The connecting electrode 160 may then be left in place during heating or at least partially removed before, during, or after heating, for instance to allow an escape of excess material generated as a result of heating, sintering, and/or compression, such as melted capsule material or a gaseous or particulate byproduct. In one embodiment, said excess material may also be at least partially retained within spark plug 100. In one embodiment, the capsule as heretofore described in the above examples may be capsule 300 as shown in FIG. 3.

The spark plug 100 may further be provided with threads, seals and the like that may be arranged on the outside of the spark plug blank. The ground electrode 180 may also be attached to the spark plug blank after heating the capsule having the at least one powder.

Figure 3:
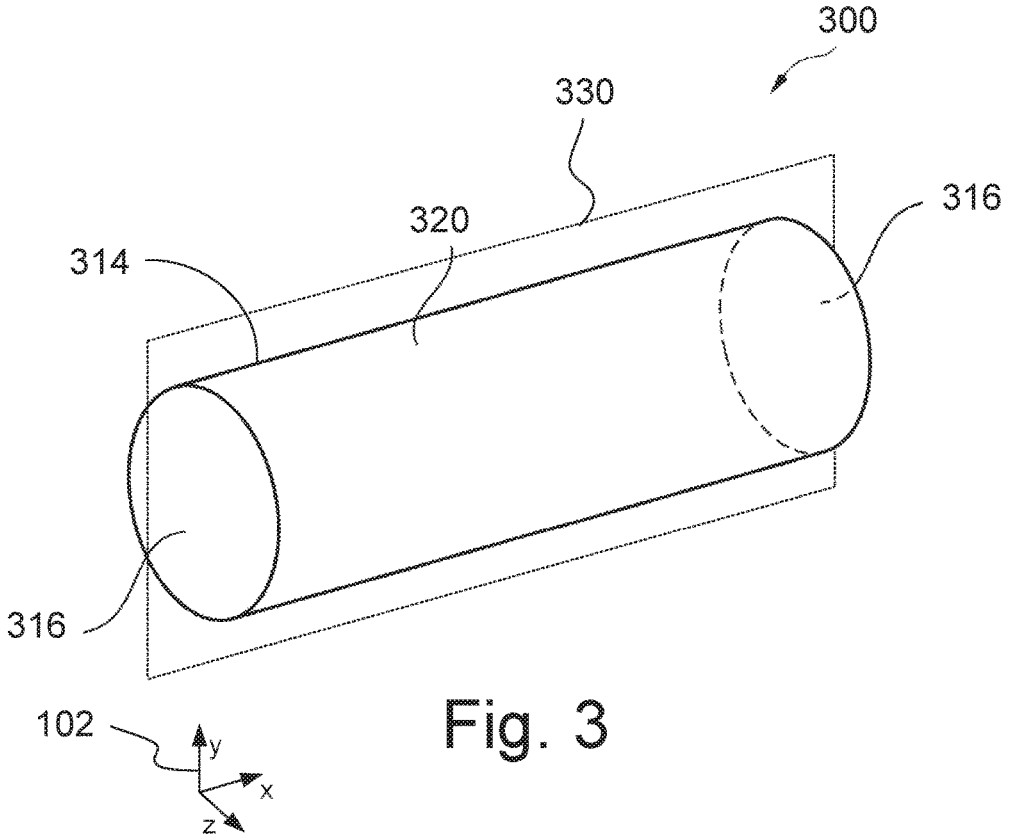
FIG. 3 illustrates a perspective view of a capsule in accordance with the present disclosure.

FIG. 3 illustrates a capsule 300 in accordance with the present disclosure for use in a method also in accordance with the present disclosure for producing a spark plug. The illustrated embodiment of capsule 300 may comprise a cylindrical form having a circular cross section. However, capsules having other cross-sectional shapes may also be provided. For instance, the capsule may be of an irregular or amorphous shape due to being constructed of a non-rigid material, such as a soft wax. The cross-section of capsule 300 may further be shaped to accommodate the shape of the space in which it is to be inserted. For instance, a cross-sectional profile of capsule 300 may be fitted to a cross-sectional profile of a central cavity of insulator 120, which in one example may have a groove or a flat side, possibly for the orienting or positioning of other components.

The longitudinal or axial profile of capsule 300 may also deviate from the straight-sided embodiment shown in FIG. 3. For example, an axial profile of capsule 300 may feature sidewalls that are not parallel, such that capsule 300 is shaped like a cone or a section or a cone, possibly such that capsule 300 may better fit a space such as hollow chamber 150. In one example, one end of capsule 300 may have a different radial width than an opposite end of capsule 300, which may give the capsule a two-tiered shape, with a wider cylindrical tier and a narrower cylindrical tier. In some examples, a two-tiered or otherwise asymmetrical shape may serve to orient capsule 300 such that it may only be inserted one way. In one example, this may be to correctly orient an intentionally asymmetrical loading of powder inside the capsule, such as an end-loading of a powder zone with an electrical resistance or resistivity intended specifically to contact the central electrode 130 and not the connecting electrode 160.

The capsule 300 may further comprise a housing 314. In one embodiment, the housing 314 may be manufactured from a material that is unstable when subjected to heat such as, for example, a polymer or a wax. A material of the housing 314 may become unstable when heated past a threshold temperature, wherein, for example, it may melt, burn away, vaporize, evaporate, break apart, change phase, or chemically react. The housing 314 also may comprise end faces 316 and/or a peripheral surface 320. In one embodiment of the capsule 300 in accordance with the present disclosure, the end faces 316 may be manufactured from an electrically conductive material and the peripheral surface 320 may be manufactured from an electrically insulating material. In such cases, peripheral surface 320 may remain in place while the end faces 316 become unstable during heating, such as by melting, burning, etc. A material may be used for the end faces 316 that melts during heating of the capsule and as a consequence supports a contact between the electrical resistor 210 and the connecting electrode 160 on one side and/or central electrode 130 on the other side. It may be desirable in some cases for a material of peripheral surface 320 to be electrically insulating so as to avoid the formation of an electrical short between the central electrode 130 and the connecting electrode 160. For peripheral surface 320 a material may also be used that melts or otherwise becomes unstable during heating of the capsule. In some embodiments, a material may be used that either remains solid or becomes volatile to avoid the displacement of at least some excess material of the housing 314, such as melted material which may be displaced during the compressing procedure, which may in some cases impair the placement of powder.

A powder comprised in capsule 300 may be a granular or particulate material that is electrically resistive. In one embodiment, a mass of powder may be electrically resistive prior to heating, fusing, and/or sintering. In a further embodiment, a mass of powder may produce an electrically resistive mass when heated to a threshold temperature. A mass of powder may become fused and/or sintered when heated to a threshold temperature, wherein the mass may coalesce into a solid and/or porous mass. An electrical resistivity of a fused or sintered mass may be different from an electrical resistivity of a powdered precursor or a mass of powdered precursor. A mass of powder, a fused mass, and/or a sintered mass may act as an electrical resistor in a spark plug.

Figure 4:
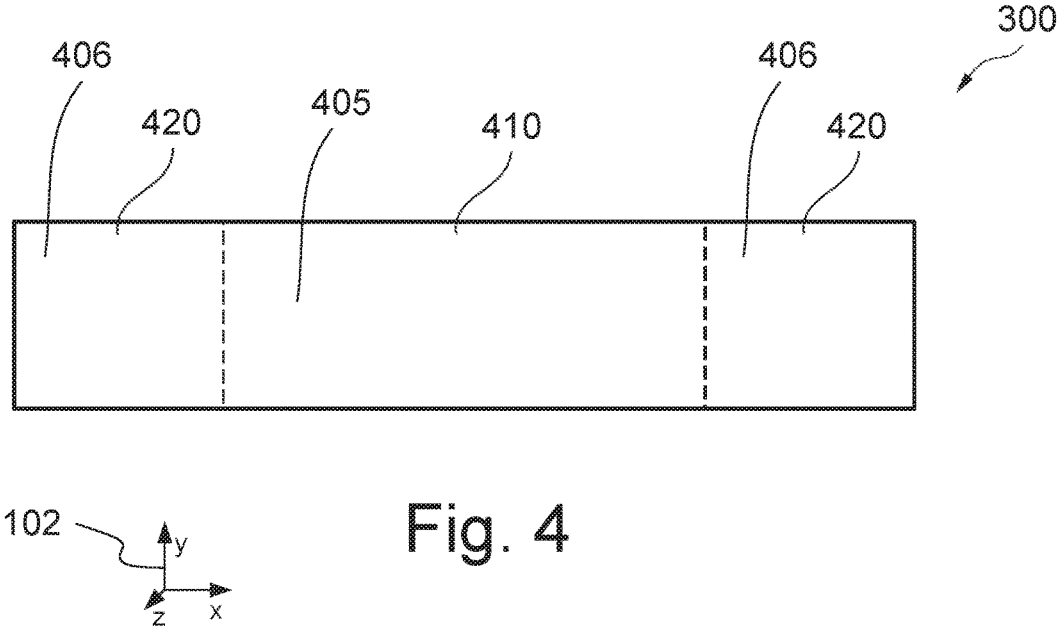
FIG. 4 illustrates a cross-sectional view of a capsule in accordance with the present disclosure.

FIG. 4 illustrates a cross-sectional view of capsule 300 in accordance with the present disclosure. The cross-sectional plane 330 is shown in FIG. 3. In the illustrated exemplary embodiment, capsule 300 may be filled with two different powders 405 and 406, of which one powder 405 may be located in a first region 410 of the capsule 300 and the other powder 406 may be located in a second region 420. The second region 420 may be divided into two parts that may be separated from one another by the first region 410, wherein said two parts may further abut against the end faces 316 of the capsule 300. For example, a capsule 300, which may be closed on one end face 316 and open on an opposite end face 316, such the capsule may stand on the closed end face 316 and be filled from the opening, may further be filled with a first powder, followed by a second powder, further followed by a second filling of the first powder, and subsequently closed at its open end face 316. The capsule 300 produced therein would comprise internal regions of powder as embodied in FIG. 4. In a different embodiment, three zones may each comprise a different powder, e.g. a first, second, and third powder.

Powder types may be selected for desirable physical properties, such as a threshold temperature at which an intended sintering, fusing, or other transformation is afforded, or for desirable physical properties of a product material thereby generated, such as a tolerance to chemical corrosion, extremes in temperature or temperature change, or for a desired amount of malleability or compressibility. A powder used in a second region 420, which may be an end region, may in one embodiment be selected for physical characteristics such as compactibility, so that it may mold or form firmly around an end of an electrode such as central electrode 130, which may be effected by compression of the capsule or powder. Powders used may further differ in characteristics including but not limited to electrical resistivity, and/or the electrical resistivity of a product material generated by heating. For example, the first region 410 may be filled with a powder having a greater electrical resistivity or resistance than the powder in the second region 420. A powder of the second region 420 may be selected to have lower electrical resistivity such that it may form a better contact with an electrode such as central electrode 130. A capsule 300 comprising powder regions such as first region 410 and second region 420, when heated, may produce an electrically resistive mass comprising zones with different electrical or physical properties, which may correspond to regions of different powder precursors in a powder capsule. In one embodiment, the capsule 300 as embodied in FIG. 4 may form the resistor 210, wherein a first zone 220 of resistor 210 may correspond to a first powder region 410 and a second zone 230 of resistor 210 may correspond to a second powder region 420.

In the case of one embodiment of the capsule 300 having end faces 316 that may be embodied from an electrically conductive material and melt during heating of the capsule but do not become volatile, said powder in one or more second regions 420 may be omitted or may be replaced by means of the resistive powder of the first region 410. In such cases, a melted or plasticized conductive material of end-faces 316 may provide a secure conductive contact with one or more electrodes, such as connecting electrode 160 or central electrode 130.

In a further embodiment, capsule 300 may comprise one or more additional regions of powder in addition to the first region 410 and second region 420 disclosed in the above examples. The one or more additional regions may comprise powders which may be one or more of powders 405 and 406 contained in first region 410 and/or second region 420, or may contain one or more powders that are different from the powders contained in first region 410 and/or second region 420.

Figure 5:
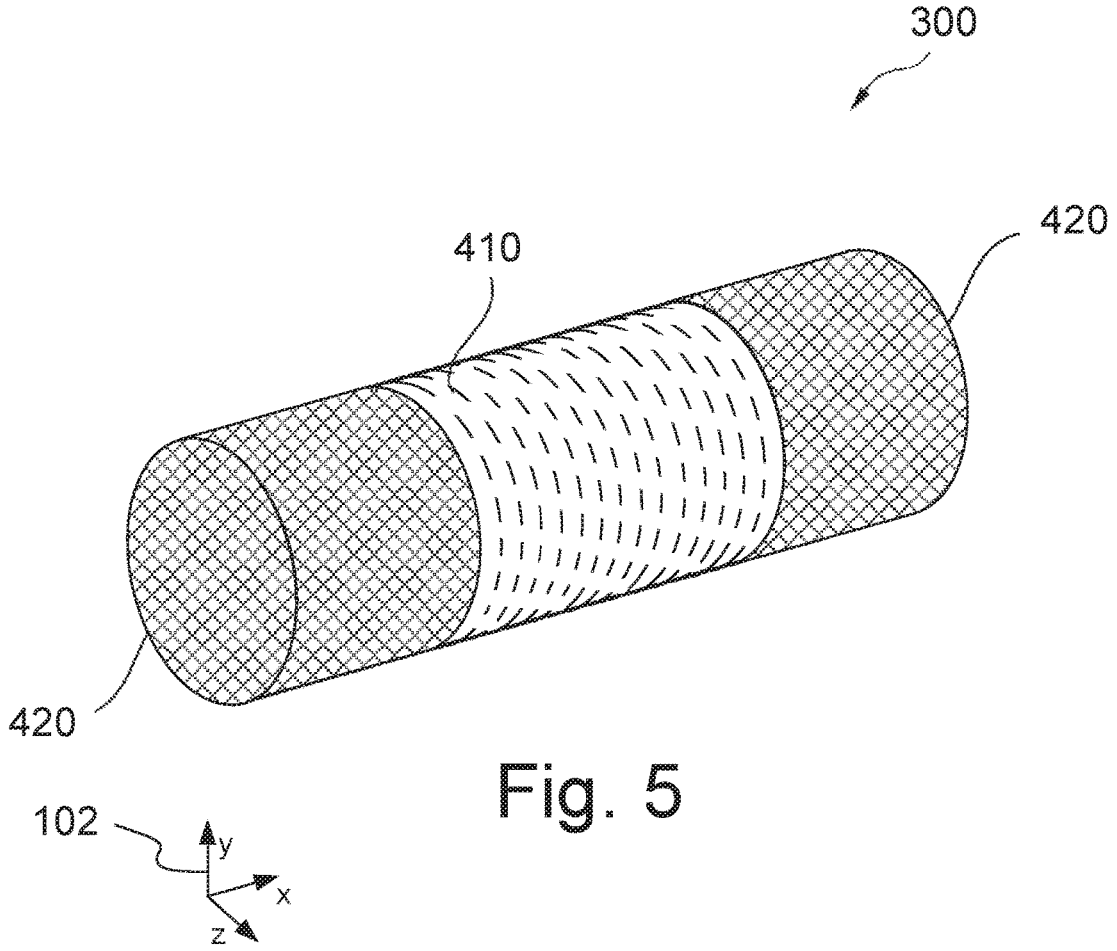
FIG. 5 illustrates a perspective view of another capsule in accordance with the present disclosure.

FIG. 5 illustrates a further embodiment of capsule 300. In the illustrated embodiment, capsule 300 may comprise a binder which may encapsulate one or more powders. In a further embodiment, capsule 300 may comprise powder and a binder that is bound and/or pressed into the form of a pellet. In one example, the pellet may take the shape of a housing 314 of capsule 300 as embodied in FIG. 3. In a further example, a first powder may occupy region 410 and a second powder may occupy region 420 of capsule 300. In some embodiments, the binder may adhere the powder in a desired shape, and/or the powder may be embedded in the binder. In some embodiments, the binder may comprise a material that may be unstable when subjected to heat above a threshold temperature. In one embodiment, the binder may comprise a wax or polymer. When subjected to heat above a threshold temperature, in some examples, the binder may melt, burn away, vaporize, evaporate, break apart, change phase, or chemically react. Capsule 300 may comprise a binder in addition to or in place of a housing 314. In one example, capsule 300 may comprise one or more powders or powder zones adhered by a binder, wherein the powder and binder are formed into a pellet. Binder material may be mixed and/or distributed uniformly throughout the powder mass. The pellet may comprise a partial or full housing 314 as previously described, or may comprise no housing 314. The pellet may be inserted into insulator 120, compressed, and fused or sintered into a resistive mass when heated to a threshold temperature.

Figure 6A:
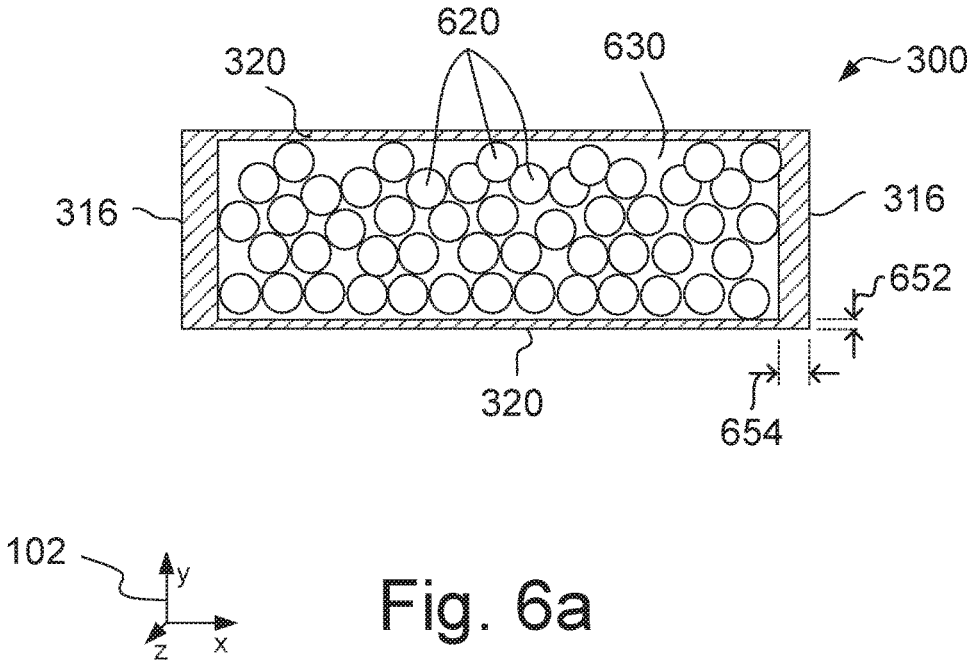
FIG. 6*a* illustrates a schematic view of a capsule in accordance with the present disclosure.

FIG. 6*a* shows a schematic representation of an embodiment of capsule 300 wherein one or more powders are contained within a housing such as housing 314. FIG. 6*a* is intended to illustrate the physical relationship between a capsule housing and a powder contained within the housing, and components therein are not drawn to scale to enhance visibility. In particular, housing 314 is shown as a vessel with walls of a defined thickness, and a plurality of powder particles 620 (shown enlarged for visibility) may be contained in an empty space 630 in the interior of the housing 314. In one example, peripheral face 320 may be a side wall of housing 314 with a thickness 652. Additionally or alternatively, end face 316 may be an end wall of housing 314 with a thickness 654. In the illustrated embodiment, thickness 654 is greater than thickness 652, but other embodiments are possible such that an end wall may have an equal thickness or lesser thickness than a side wall. In one example wherein end faces 316 are one or more end walls, one end wall may be thicker than another end wall. End walls and side walls may also have thicknesses that vary. In one example wherein peripheral face 320 is a side wall, a thickness of a side wall may vary due to being made of a soft wax material which may not hold a uniform thickness during formation. Thicknesses of housing walls may also be adjusted such that the capsule has adequate structural strength but also such that use of an excess of housing material is avoided. Excess material may be avoided in one example to reduce waste, or in another example to reduce an amount of material which needs to be burned away during a heating process. A capsule 300 in accordance with FIG. 6*a* may be produced in one example by mechanically filling a housing 314, wherein one or more end-faces 316 may be open to facilitate filling and subsequently closed or sealed.

Figure 6B:
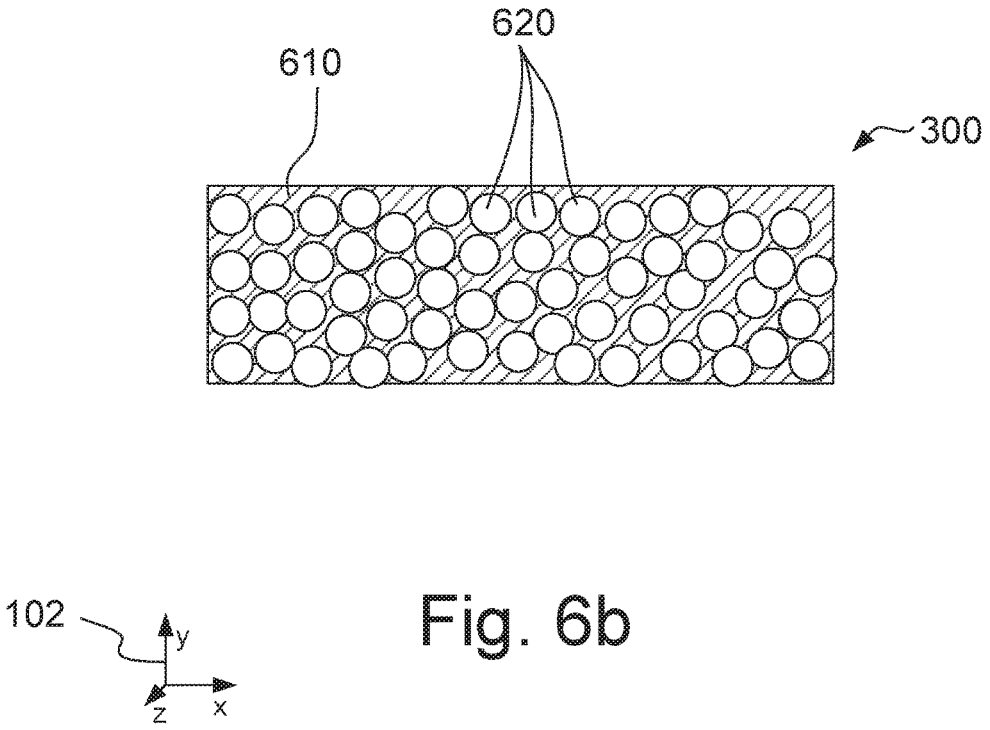
FIG. 6*b* illustrates a schematic view of another capsule in accordance with the present disclosure.

FIG. 6*b* shows a schematic representation of another embodiment of capsule 300 wherein one or more powders are contained in a binder material 610. FIG. 6*b* is further intended to illustrate the relationship between a binder material 610 and a powder contained within the binder material, and components therein are not drawn to scale to enhance visibility. In the illustrated embodiment, the binder material 610 is distributed throughout the capsule 300, and powder particles 620 are encapsulated within the mass of the binder material. Such a capsule 300 may be produced in one example by mixing powder particles 620 with a melted binder material, such as a melted wax. The mixture may be molded into the shape of a capsule, cooled, and solidified in place. In other examples, a capsule 300 may be produced by mixing powder particles with a solid, powdered, and/or granulated binder precursor material and compressed to form a dry pellet.

In one embodiment, more than one capsule 300 may be inserted into insulator 120 to produce a spark plug such as spark plug 100. In one example, two or more capsules 300 may be inserted end-to-end into insulator 120. One or more of a series of capsules 300 employed in producing a spark plug may contain a powder that is different from a powder contained in one or more of the other capsules 300. One or more capsules 300 may further have different dimensions and/or amounts of powder from one or more other capsules 300. For example, an electrical resistor 210 may be produced by inserting three capsules 300 successively into insulator 120, wherein a first capsule 300 contains a first powder, a second capsule 300 contains a second powder, and a third capsule 300 contains a third powder. In one embodiment, the third powder may be the same as the first powder. In a further embodiment, the first and/or third capsules 300 may have a shorter length than the second capsule 300. In one such embodiment, the capsules, when heated to a threshold temperature, may produce a resistor that is similar and/or electrically equivalent to the electrical resistor 210 created using the capsule 300 embodied in FIG. 4. In other embodiments, an arrangement of multiple powder zones in the production of a spark plug may be accomplished using a capsule 300 containing one or more powder types and/or powder zones, or a plurality of capsules 300, each comprising one or more powder types and/or powder zones.

Figure 7:
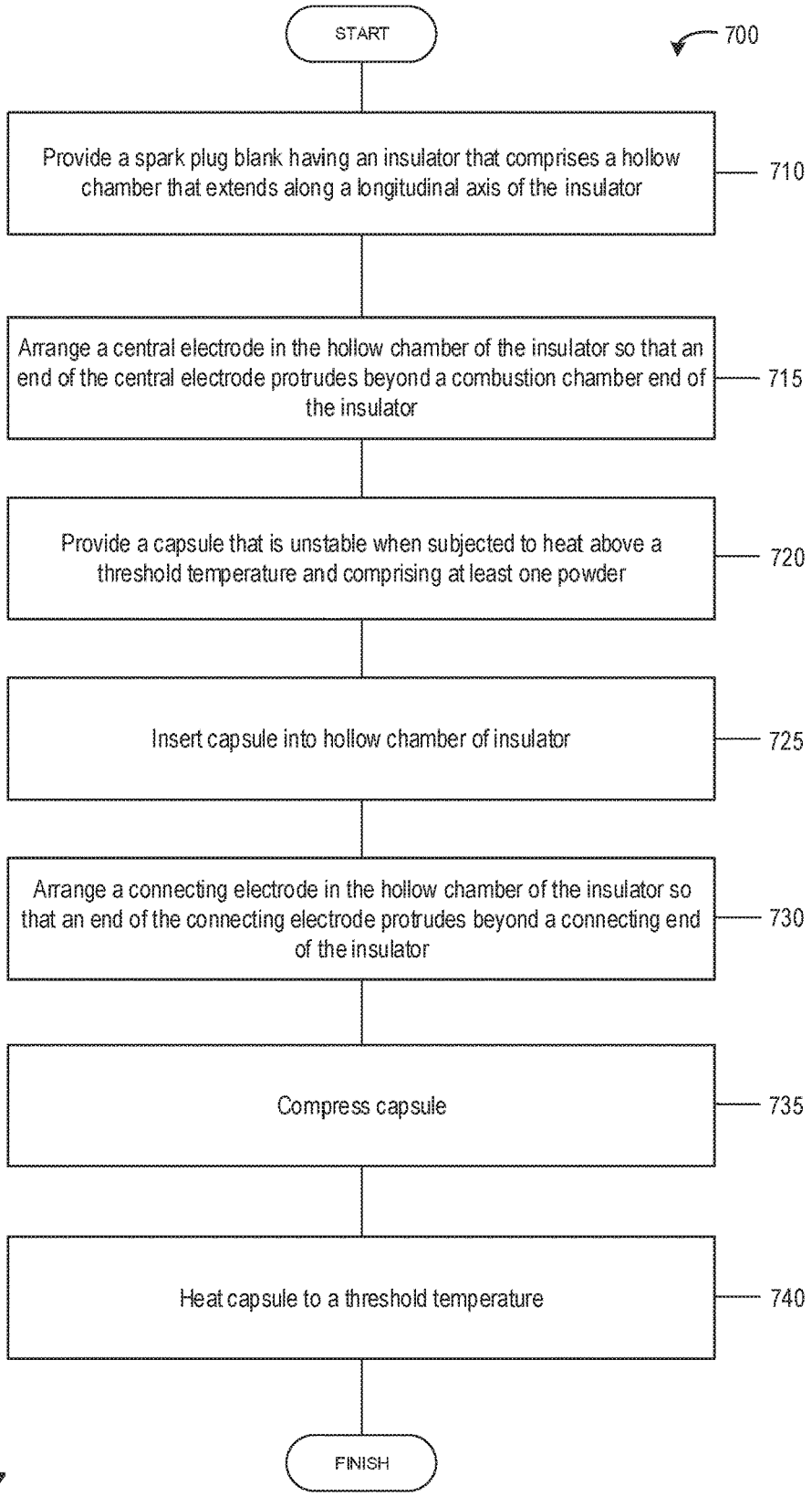
FIG. 7 shows a flow chart of a method for producing a spark plug in accordance with the present disclosure.

Turning to FIG. 7, flow chart 700 shows a method for producing a spark plug. At 710, a spark plug blank such as spark plug blank 200 may be provided. The spark plug blank may comprise an insulator such as insulator 120, further comprising a hollow chamber 150 extending along and passing through a longitudinal axis of the insulator. The spark plug blank may further comprise a central electrode 130 and/or a connecting electrode 160, or either or both electrodes may be further provided at a subsequent point in-process. At 715, central electrode 130 may be inserted and/or arranged in the hollow chamber 150. In one embodiment, an end of central electrode 130 may be arranged such that the end protrudes beyond a combustion chamber end 140 of insulator 120. Central electrode 130 may be further arranged such that central electrode interior end 132 extends into the interior of hollow chamber 150. At 720, a capsule such as capsule 300 may be provided, wherein at least part of the capsule is unstable when subjected to heat above a threshold temperature. For example, the at least part of the capsule which becomes unstable may melt, burn, vaporize, evaporate, break apart, change phase, or chemically react when subjected to heat above a threshold temperature. The capsule may also comprise at least one powder. In one embodiment, the powder may be an electrically resistive material, and/or may produce an electrically resistive mass when subjected to heat above a threshold temperature. At 725, the capsule such as capsule 300 may be inserted into hollow chamber 150 of insulator 120. In one embodiment, an end face such as end face 316 of capsule 300 may rest against and/or touch central electrode interior end 132 upon insertion into hollow chamber 150. At 730, an electrode such as connecting electrode 160 may be inserted into hollow chamber 150. In one embodiment, connecting electrode 160 may be inserted such that an end portion of connecting electrode 160 may protrude beyond a connecting end 170 of insulator 120. In a further embodiment, an connecting electrode interior end 162 may extend into the interior of hollow chamber 150. In a still further embodiment, an end face 316 of capsule 300 may rest against and/or touch connecting electrode interior end 162. An opposite end face 316 further may concurrently at least one of rest against, touch, and be adjacent to central electrode interior end 132. At 735, the capsule such as capsule 300 may be compressed. In one embodiment, compression is applied to capsule 300 at one or more end faces 316. In a further embodiment, capsule 300 is compressed by an end of central electrode 130 and/or connecting electrode 160. In a still further embodiment, the capsule may deform and/or form around an end of central electrode 130 and/or connecting electrode 160 as a result of compression. Such forming may provide a secure electrical contact and/or mechanical connection between a formed electrical resistor and one or more of said electrodes. The powder mass comprised in capsule 300 may also be compacted as a result of compression. In one embodiment, the powder mass comprised in capsule 300 may expand and/or be pressed against the walls of hollow chamber 150, and/or any other adjacent hardware or structures. In a further embodiment, the powder mass comprised in capsule 300 may be formed to the shape of the space it occupies as a result of compression. At 740, heat may be applied to the capsule at or above a threshold temperature. In one embodiment, heat above the threshold temperature may cause at least a part of the capsule, which may be capsule 300, to become unstable, wherein in some embodiments the at least part of the capsule may melt, burn, vaporize, evaporate, break apart, change phase, or chemically react. The powder mass comprised in the capsule may further be caused to fuse, sinter, and/or form an electrically resistive mass. Heating and compression of the capsule may or may not occur concurrently. In one embodiment, the electrically resistive mass may be resistor 210. In a further embodiment, the electrically resistive mass may be at least partially fused into a solid mass. In an alternative embodiment, the electrically resistive mass may remain at least partially powdered, granular, or may comprise partially fused or clustered formations. Upon the formation of the electrically resistive mass, a resistive electrical contact may be made between connecting electrode 160 and central electrode 130. A voltage provided to connecting electrode 160 may be conducted across the electrically resistive mass, which may be or may be electrically equivalent to an electrical resistor, to central electrode 130, wherein the voltage may jump to a ground electrode such as ground electrode 180 and generate a spark.

Figure 8:
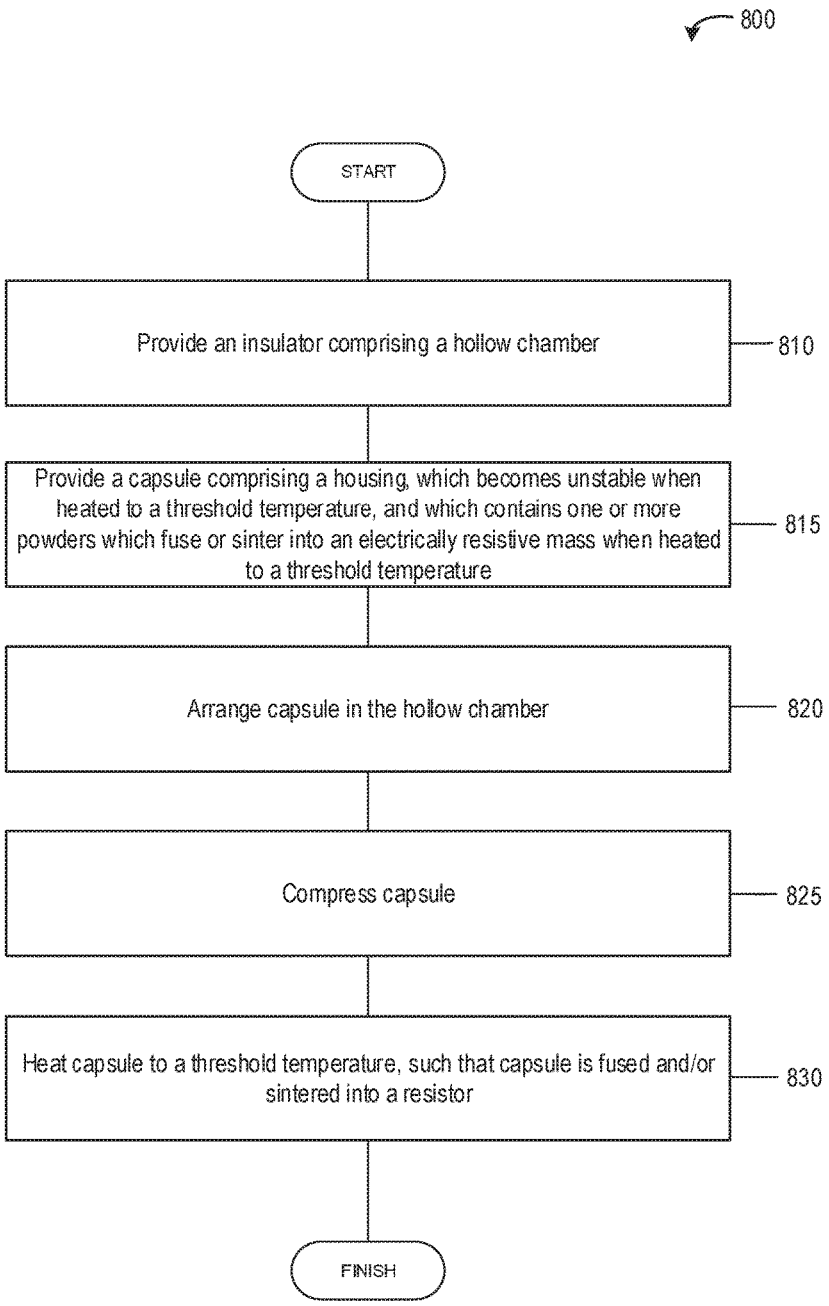
FIG. 8 shows a flow chart of a method for producing a spark plug component in accordance with the present disclosure.

Turning to FIG. 8, flow chart 800 illustrates a method for producing a spark plug resistor for use in a spark plug electrical circuit. At 810, an insulator such as insulator 120 may be provided. The insulator may comprise a central cavity such as hollow chamber 150, which passes through its longitudinal axis. At 815, a capsule such as capsule 300 may be further provided, comprising a housing 314. The housing 314 may become unstable when heated to a threshold temperature. Capsule 300 may further comprise one or more powders, which may fuse or sinter into an electrical resistor when heated to a threshold temperature. At 820, the capsule 300 may be arranged in the central cavity of the insulator. In one embodiment, the central cavity may be hollow chamber 150. At 825, the capsule may be compressed. In one embodiment, the capsule may be compressed between one or more ends of one or more electrodes, which may be one or more of central electrode 130 and connecting electrode 160. In another embodiment, the capsule may be compressed from one or more end faces by a tool which is inserted into the central cavity. The tool may be removed from the central cavity subsequent to compressing the capsule. At 830, capsule 300 may be heated to a threshold temperature such that at least part of capsule 300 is fused, sintered, or formed into an electrical resistor, which may be resistor 210. Upon compression and/or heating, the electrical resistor may be fused to or mechanically held to the insulator 120. In one example, the resistor may be formed to one or more grooves on an interior wall of insulator 120 such that the resistor is mechanically held in place. In another example, the resistor may move freely of insulator 120 such that the insulator's position may be changed or adjusted. For instance, adjustments in the positions of one or more electrodes inserted into insulator 120 may move a position of an electrical resistor formed therein.

The capsule 300 in accordance with the present disclosure may simplify the production of a spark plug 100 and may render it possible to produce the desired electrical resistor 210 with a greater precision, and/or at a minimal expense. Additionally or alternatively, the methods shown in flow chart 700 and/or flow chart 800 describe procedures which may be incorporated into a production process of a spark plug and/or a spark plug resistor. The disclosed methods may render it possible to produce a spark plug comprising a resistor, or a component of a spark plug comprising a resistor, with a greater precision, reduced expense, and/or minimization of process waste.

The methods and devices described in accordance with the present disclosure offer a way to produce a spark plug, such as spark plug 100, with a greater precision, and/or at a minimal expense. In particular, the electrical resistor 210 inside spark plug 100 may be produced more reliably by encapsulating precursor materials in a capsule such as capsule 300, which may be more easily and/or efficiently handled in a spark plug manufacturing or production process than a process in which bulk or loose powders are inserted into a spark plug blank. In addition, series of powders or powder zones, such as first region 410 and/or second region 420, may be more easily and/or efficiently arranged in the production of a capsule than in the production of a spark plug. In producing a capsule that contains one or more precursor powders arranged in one or more precursor powder zones, such an arrangement of powder zones can be more easily and/or reliably placed into a spark plug blank in a production process while preserving the precise arrangement of powders within the capsule. In encapsulating precursor materials prior to the spark plug production process, powder fills may be more effectively quality-controlled, and a spark plug production process may be simplified due to alleviating the need to accommodate and quality-control a powder-filling process in-line with a spark-plug assembly process.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for producing spark plugs, comprising:

providing a spark plug blank having an insulator that comprises a hollow chamber that extends along a longitudinal axis of the insulator;

arranging a central electrode in the hollow chamber of the insulator so that an end of the central electrode protrudes beyond a combustion chamber end of the insulator;

providing a capsule that is filled with at least one powder;

inserting the capsule into the hollow chamber of the insulator;

arranging a connecting electrode in the hollow chamber of the insulator so that an end of the connecting electrode protrudes beyond a connecting end of the insulator; and heating the capsule.

2. The method of claim 1, further comprising compressing the capsule that is arranged in the hollow chamber between the central electrode and the connecting electrode.

3. The method of claim 2, wherein compressing and heating the capsule are performed simultaneously.

4. The method of claim 1, further comprising producing the capsule that is filled with at least one powder.

5. The method of claim 4, further comprising producing a capsule housing and filling the capsule housing with the at least one powder.

6. The method of claim 5, wherein the capsule housing is manufactured at least in part from a material that is unstable when subjected to heat above a threshold temperature and, wherein during heating the capsule, the capsule is heated above the threshold temperature.

7. The method of claim 6, wherein the at least one powder is sintered or melted during heating of the capsule.

8. The method of claim 5, wherein a first region of the capsule is filled with a first powder having a first electrical resistance and a second region of the capsule is filled with a second powder having a second electrical resistance that is different from the first electrical resistance.

9. The method of claim 8, wherein the second region is divided into a first part and a second part and said parts are arranged spatially separated from one another on opposite-lying sides of the first region.

10. The method of claim 8, wherein the first electrical resistance is greater than the second electrical resistance.

11. A capsule for use in producing a spark plug, wherein the capsule is filled with at least one powder.

12. The capsule of claim 11, further comprising a housing.

13. The capsule of claim 12, wherein the housing is manufactured at least in part from a material that is unstable when subjected to heat above a threshold temperature.

14. The capsule of claim 13, wherein the housing one or more of melts, burns away, vaporizes, evaporates, breaks apart, changes phase, or chemically reacts, when subjected to heat above a threshold temperature.

15. The capsule of claim 14, wherein a first region of the capsule is filled with a first powder having a first electrical resistance and a second region of the capsule is filled with a second powder having a second electrical resistance that is different to the first electrical resistance.

16. The capsule of claim 15, wherein the first electrical resistance is greater than the second electrical resistance.

17. The capsule of claim 15, wherein the second region is divided into a first part and a second part and said parts are arranged spatially separated from one another on opposite-lying sides of the first region.

18. A method for producing a spark plug resistor, the method comprising:

providing an insulator comprising a central cavity passing through the insulator;

providing a capsule, comprising a housing which becomes unstable when heated to a first threshold temperature, and one or more powders, which fuse or sinter into an electrically resistive mass when heated to a second threshold temperature;

arranging the capsule in the central cavity of the insulator, compressing the capsule, and heating the capsule to a threshold temperature exceeding each of the first and second threshold temperatures, such that the capsule is fused or sintered into an electrically resistive mass.

19. The method of claim 18, further comprising compressing the capsule between an interior end of a central electrode and interior end of a connecting electrode.

20. The method of claim 19, wherein the central electrode and connecting electrode make electrical contact across the electrically resistive mass, such that the electrically resistive mass provides an electrical resistance between the central electrode and the connecting electrode.

* * * * *